US005320249A

United States Patent [19]

Strech

[11] Patent Number: 5,320,249

[45] Date of Patent: Jun. 14, 1994

[54] INSULATED JACKET FOR A CONICAL CONTAINER

[76] Inventor: Kenneth R. Strech, 2598 Mt. View Ave., San Bernardino, Calif. 92405

[21] Appl. No.: 78,614

[22] Filed: Jun. 17, 1993

[51] Int. Cl.[5] ..... B65D 3/28

[52] U.S. Cl. ..... 220/739; 220/754; 220/771

[58] Field of Search ..... 220/738, 739, 754, 771

[56] References Cited

U.S. PATENT DOCUMENTS

| | | | |
|---|---|---|---|
| 1,950,505 | 3/1934 | Matters | 65/61 |
| 3,138,280 | 6/1964 | Shafer | 220/739 |
| 4,928,873 | 5/1990 | Johnson | 220/739 |
| 5,147,067 | 9/1992 | Effertz | 220/739 |
| 5,169,025 | 12/1992 | Guo | 220/739 |
| 5,222,656 | 6/1993 | Carlson | 220/739 |

*Primary Examiner*—Joseph Man-Fu Moy
*Attorney, Agent, or Firm*—Macro-Search Corp.

[57] ABSTRACT

An insulated jacket for a conical shaped container is disclosed. A flat strip of flexible, thermal insulating material has a pair of opposing side surfaces defined by a pair of non-parallel, opposing end edges that are contiguous with a pair of opposing, curved, mainly parallel side edges. A two-part hook-and-loop type fastener is included, one of each part being fixed to each one of the side surfaces adjacent to each one of the opposing end edges. A pair of opposing handle strips may be further included that extend in opposing directions from opposing side edges. Each one of the handle strips provides one part of a second hook-and-loop type fastener for joining with the other of the handle strips so as to form a handle for holding the jacket and the container. In use, with each part of the first fastener brought into mutual opposing proximity, and with the end edges held in approximate parallel alignment, and with the fastener parts then joined, the jacket assumes the shape of a cone frustum for fitting tightly over the sidewall of the conical shaped container.

5 Claims, 2 Drawing Sheets

INSULATED JACKET FOR A CONICAL CONTAINER

FIELD OF THE INVENTION

This invention relates generally to beverage and food container insulators, and, more particularly, is directed towards an insulated jacket for a conical container.

BACKGROUND OF THE INVENTION

Insulating jackets for maintaining the temperature of a beverage or food within a container are known in the prior art. Many such jackets are formed as hollow cylinders through which the container is inserted. Other such jackets are cut from a flat sheet of insulating material so as to be wrapped around the container and then fastened end to end to secure the jacket onto the container. For example, U.S. Pat. No. 1,950,505 to Matters on Mar. 13, 1934, illustrates such a device. Another example of a such a prior art container insulator is found in U.S. Pat. No. 5,147,067 to Effertz on Sep. 15, 1992. Such a device includes a cut-out handle arrangement for providing a convenient means by which to grasp the insulator and container.

While such devices may be well-suited for use with cylindrical containers, conical containers are not effectively held in such prior art devices, which can lead to spilling of the beverage or food from the container. However, many conical containers and cups are in use today, such conical containers having the advantage that they may be conveniently stacked. As a result, many people who desire to use an insulating jacket on their conical containers, heretofore, have been unable to do so effectively or safely. Further, the prior art container jackets have the disadvantage of having to be stored in a cupboard drawer, or the like, when not in use. It is often the case, however, that when a person is preparing a beverage or food item he will not think to use an insulator for the container unless he is reminded to use the insulator by seeing it. As a result, such prior art insulating jackets often go unused, even when they could be used effectively and advantageously on a cylindrical container.

Clearly, then, there is a need for a container insulator, and more particularly, for a conical shaped insulator for food or beverage containers, such as those universally used for ice cream, that is effective for thermal insulation and handling thereof. Further, such a needed invention would be easy to manufacture and use, and would include an easy to use handle. Still further, such a needed invention would allow the device to be stored and displayed on a nearby surface, such as that of a refrigerator or the like, so as to be prominently visible when one is preparing a beverage or the like. The present invention fulfills these needs and provides further related advantages.

SUMMARY OF THE INVENTION

The present invention is an insulated jacket for a conical shaped container. A flat strip of flexible, thermal insulating material has a pair of opposing side surfaces defined by a pair of non-parallel, opposing end edges that are contiguous with a pair of opposing, curved, mainly parallel side edges. A two-part surface joining means in included, one of each part being fixed to each one of the side surfaces adjacent to each one of the opposing end edges. A pair of opposing handle strips may be further included that extend in opposing directions from opposing side edges. Each one of the handle strips provides a joining means for joining with the other of the handle strips so as to form a handle for holding the jacket and the container. In use, with each one of the two part joining means brought into mutual opposing proximity, and with the end edges held in approximate parallel alignment, and with the joining means then joined, the jacket assumes the shape of a cone frustum for fitting tightly over the sidewall of the conical shaped container.

The present invention is a food or beverage container insulator that is effective for use with conical shaped containers. The present invention is relatively inexpensive to manufacture, easy to use, and may readily incorporate an easy to use handle. Still further, the present device may be stored and displayed on a nearby iron bearing surface, such as that of a refrigerator or the like, so as to be prominently visible when one is preparing a beverage. Further, the present device may be stored flat or rolled, depending upon which is most convenient at the time. Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
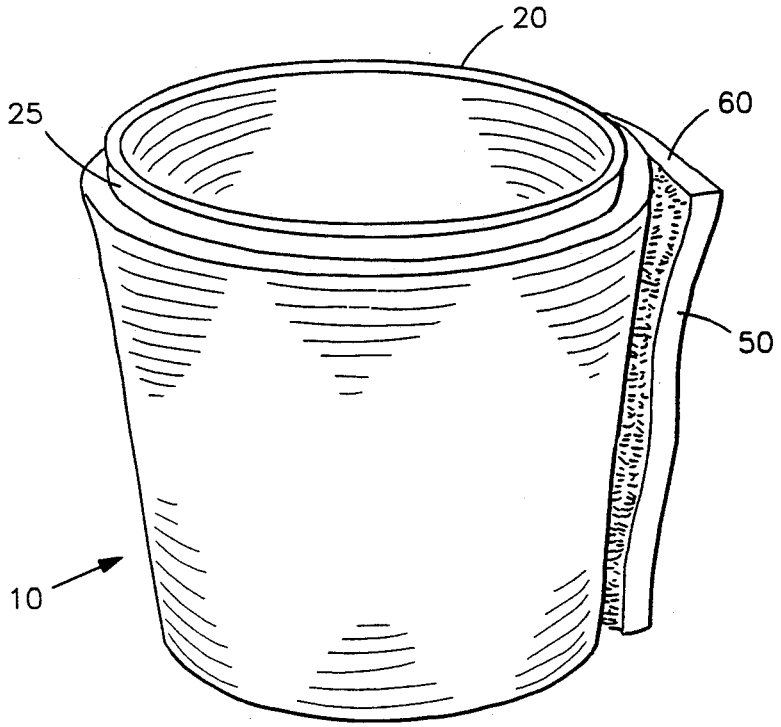
FIG. 1 a perspective illustration of the invention, illustrating a jacket fitted tightly over a conical shaped container.
Figure 2:
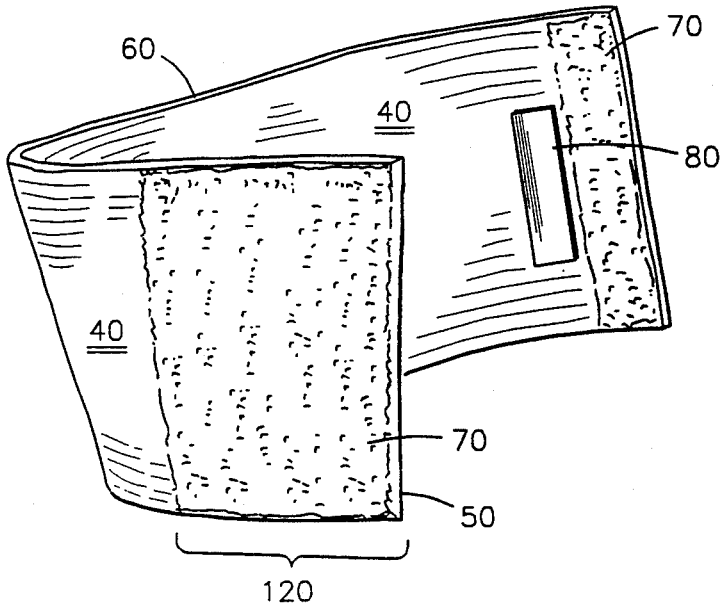
FIG. 2 is a perspective illustration of the invention, illustrating the jacket of the invention in a partially curved position and further illustrating a magnet of the invention.

FIGS. 1 and 2 illustrate an insulated jacket 10 for a conical shaped container 20 having an outer side wall 25. Such a conical shaped container 20 may be any of the standard one-pint ice cream containers, or a readily available instant soup container, or the like. A flat strip 30 of flexible, thermal insulating material has a pair of opposing side surfaces 40 defined by a pair of non-parallel, opposing end edges 50 that are contiguous with a pair of opposing, curved, mainly parallel side edges 60. A flat magnet 80 may be further attached to one of the side surfaces 40 in order to hold the jacket 10 onto an iron bearing surface (not shown) for storage and display of the jacket 10 while the jacket 10 is not being used to insulate the container 20. In this regard, the jacket 10 might be stored on the side of a metal freezer or refrigerator, ready to be used with a cold container stored within. While hanging on the refrigerator, one of the side surfaces 40 is plainly visible and so might be used to carry a commercial message, logo, or the like.

A two-part surface joining means 70 is included, one of each part being fixed to each one of the side surfaces 40 adjacent to each one of the opposing end edges 50. Preferably, the joining means 70 is a hook-and-loop type fastening material, one part of which extending over an area 120 of at least one of the side surfaces 40 to an extent as to allow the two-part joining means 70 to be fastened over a range of positions. As such, the jacket 10 may be tightly fitted to a range of sizes of containers 20.

Figure 3:
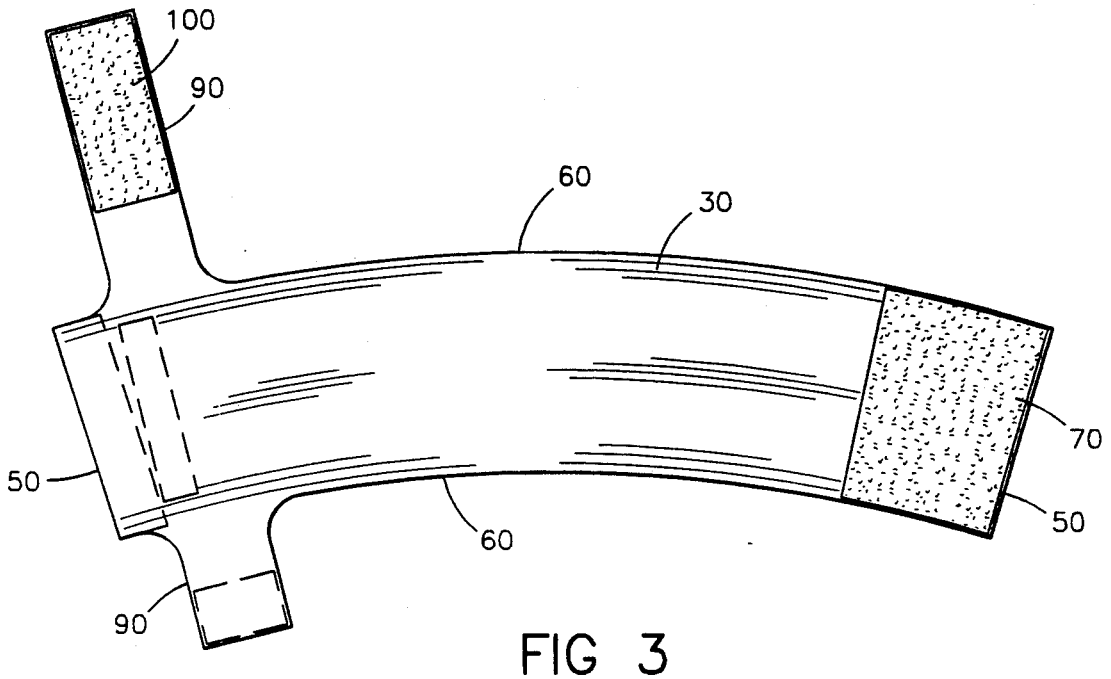
FIG. 3 is a top plan view of the invention, illustrating the jacket of the invention lying flat, and further illustrating a pair of handle strips of the invention.
Figure 4:
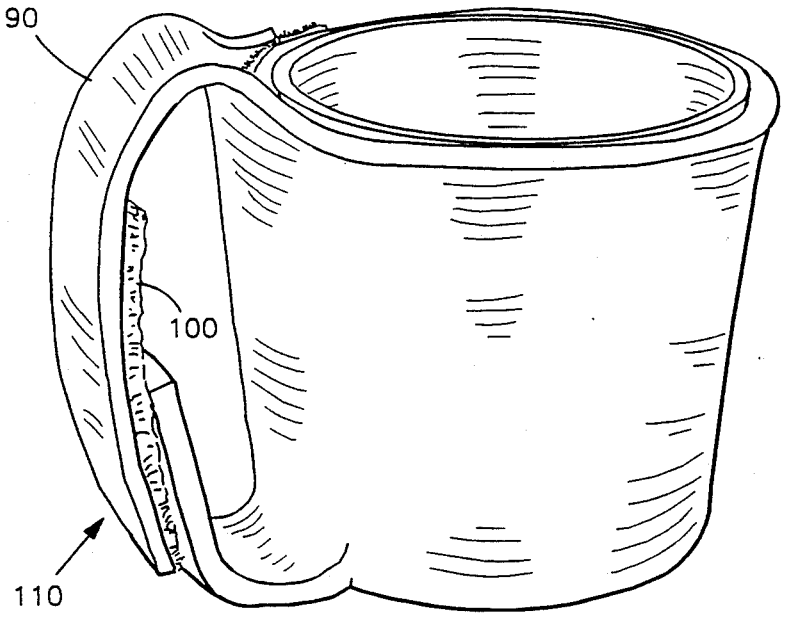
FIG. 4 is a perspective illustration of the invention, illustrating the jacket of the invention fitted tightly over the conical shaped container, and further illustrating the handle strips joined to form a handle of the invention.

A pair of opposing handle strips 90 may be further included. These might extend in opposing directions from opposing side edges 60, as shown in FIGS. 3 and 4. Each one of the handle strips 90 provides a joining means 100 for joining with the other of the handle strips 90 so as to form a handle 110 for holding the jacket 10 and the container 20 (FIG. 4). Such a joining means 100 is preferably a hook-and-loop type fastening material, or the like. Such a handle 110, being formed from the flexible material, aids in gripping the jacket 10 when the user's hand is slipped through the handle 110 while holding the jacket 10.

In use, with each one of the two part joining means 70 brought into mutual opposing proximity, and with the end edges 50 held in approximate parallel alignment, and with the joining means 70 then joined, the jacket 10 assumes the shape of a cone frustum for fitting tightly over the sidewall 25 of the conical shaped container 20.

While the invention has been described with reference to a preferred embodiment, it is to be clearly understood by those skilled in the art that the invention is not limited thereto. Rather, the scope of the invention is to be interpreted only in conjunction with the appended claims.

I claim:

1. An insulated jacket for a conical shaped container comprising a flat strip of flexible, thermal insulating material having a pair of opposing side surfaces defined by a pair of non-parallel, opposing end edges contiguous with a pair of opposing, curved, mainly parallel, side edges, and a two part surface joining means, one of each of the parts of the two part joining means being fixed to each one of the side surfaces adjacent to each one of the opposing end edges, such that with each one of the two part joining means brought into mutual opposing proximity, and with the end edges held in approximate parallel alignment, and with the joining means then joined, the jacket assumes the shape of a cone frustrum for fitting tightly over the sidewall of the conical shaped container, the jacket further including a pair of opposing handle strips extending in opposing directions from opposing said side edges, each one of the handle strips providing means for joining with the other of the handle strips so as to form a handle for holding the jacket and the container.

2. The insulated jacket for a conical shaped container of claim 1 further including a flat magnet attached to one of the side surfaces in order to hold the jacket onto an iron bearing surface for storage and display of the jacket.

3. The insulated jacket for a conical shaped container of claim 1 wherein the joining means is hook and loop type fastener material.

4. The insulated jacket for a conical shaped container of claim 1 wherein the joining means is hook and loop type fastener material.

5. The insulated jacket for a conical shaped container of claim 1 wherein the two part joining means extends over an area of at least one of the side surfaces to an extent as to allow the two part joining means to be fastened over a range of positions so that the jacket may be tightly fitted to a range of container sizes and shapes.

* * * * *

UNITED STATES PATENT AND TRADEMARK OFFICE

CERTIFICATE OF CORRECTION

PATENT NO. : 5,320,249

DATED : June 14, 1994

INVENTOR(S) : Kenneth R. Strech

It is certified that error appears in the above-indentified patent and that said Letters Patent is hereby corrected as shown below:

In column 4, lines 27-29, change Claim 4 to Claim 5, and change Claim 5 to Claim 4.

In column 4, in claim 4 (now claim 5), line 2, change "of claim 1" to --of claim 4--.

Column 4:

Claim 4 should depend from Claim 5.

Signed and Sealed this

Twelfth Day of December, 1995

*Attest:*

*Attesting Officer*

Bruce Lehman

BRUCE LEHMAN

*Commissioner of Patents and Trademarks*